US006168398B1

(12) United States Patent
Handtmann

(10) Patent No.: US 6,168,398 B1
(45) Date of Patent: Jan. 2, 2001

(54) PISTON PUMP HAVING LIFTING VALVES WITH A CONVEX SURFACE

(76) Inventor: Thomas Handtmann, Hugo Häringstrasse 60, 88400 Biberach (DE)

( * ) Notice: Under 35 U.S.C. 154(b), the term of this patent shall be extended for 0 days.

(21) Appl. No.: 09/087,217

(22) Filed: May 29, 1998

(30) Foreign Application Priority Data

Jun. 3, 1997 (EP) ..... 97 108 943

(51) Int. Cl.[7] ..... F04B 7/00

(52) U.S. Cl. ..... 417/510; 417/515; 417/571; 92/169.1; 137/240; 251/333

(58) Field of Search ..... 417/510, 515, 417/571; 92/169.1; 251/333; 137/240

(56) References Cited

U.S. PATENT DOCUMENTS

| | | | | |
|---|---|---|---|---|
| 1,012,725 | * | 12/1911 | Shadall | 92/169.1 |
| 2,122,398 | * | 7/1938 | Harrison | 417/510 |
| 2,308,974 | * | 1/1943 | Harper | 417/510 |
| 2,419,091 | * | 4/1947 | Sanders | 417/510 |
| 2,615,618 | * | 10/1952 | Chabay | 417/510 |
| 3,169,455 | * | 2/1965 | Hoffmann | 92/169.1 |
| 3,782,241 | * | 1/1974 | Ashley | 137/509 |
| 3,923,208 | * | 12/1975 | Bergloff | 92/169.1 |
| 4,236,881 | * | 12/1980 | Pfleger | 417/510 |
| 4,620,836 | * | 11/1986 | Brandl | 417/510 |
| 4,744,735 | | 5/1988 | Niemand . | |
| 5,252,037 | | 10/1993 | Carlson . | |

FOREIGN PATENT DOCUMENTS

| | | |
|---|---|---|
| 354813 | 10/1928 | (BE) . |
| 2452370 | 5/1976 | (DE) . |
| 2212857 | 2/1989 | (GB) . |

OTHER PUBLICATIONS

Dosieren Handbook, published by Gerhard Vetter, Vulkan–Verlag Essen, 1994, p. 132 at Picture No. 31.

* cited by examiner

*Primary Examiner*—Charles G. Freay
(74) *Attorney, Agent, or Firm*—Tilton, Fallon, Lungmus & Chestnut

(57) ABSTRACT

A piston pump comprising at least one working space, which is surrounded by a cylinder and which is adapted to be varied by a piston arranged in said cylinder, and at least one inlet valve as well as at least one outlet valve, said valves being lifting valves and being adapted to be controlled and driven by a control and drive means. In order to provide a piston pump which can be cleaned more easily and which includes the smallest possible number of dead spots, a first teaching according to the present invention suggests that, when closed, the inlet valve should be located nearer to the working space than when it is open. Alternatively, the underlying technical problem is solved according to a second solution of the present invention by the feature that the valve surface of the inlet and/or outlet valve(s) facing the working space merges without any steps with the inner surface of said working space at the closed position of the valve or of each valve.

18 Claims, 4 Drawing Sheets

PISTON PUMP HAVING LIFTING VALVES WITH A CONVEX SURFACE

FIELD OF THE INVENTION

The present invention refers to a piston pump.

BACKGROUND OF THE INVENTION

The present invention refers especially to a piston pump for conveying viscous or moderately viscous, i.e. just still flowable fluids. Such viscous or moderately viscous fluids must be conveyed and dosed e.g. in the cosmetic and pharmaceutical industry in the form of oils and creams, in the field of waste disposal technology in the form of pulpy media or sewage sludge, and, in particular, they must be conveyed and dosed in the field of food industry. The substances to be conveyed in the field of food industry are highly liquid to pulpy substances, which may occasionally also contain solid components, such as yoghurt substances with fruit, yeast substances and dregs as well as sausage substances or sausage meat.

For conveying and dosing the viscous or moderately viscous fluids mentioned hereinbefore as an example, rotating positive displacement pumps (e.g. vane pumps and lobe pumps) are known. These pumps include, however, an unavoidable gap which causes undesirable leakage. In addition, rotating positive displacement pumps are normally not suitable for conveying fluids including solid matter. Soft solid matter, e.g. pieces of fruit, is subjected to mechanical loads and broken up in rotating positive displacement pumps. In addition, rotating positive displacement pumps are very difficult to clean, especially at the point of transition from the conveyor member to the drive shaft.

Furthermore, diaphragm pumps are known for conveying and dosing viscous or highly viscous fluids. These pumps have a limited stroke so that a comparatively large diaphragm area must be chosen for conveying a sufficient amount of material, and this, in turn, results in higher forces acting on the drive unit of the pump. In addition, diaphragm fatigue will occur due to the constant cyclic stress so that cracks may form. Furthermore, diaphragm pumps show dead spots in the area where the diaphragm is fixed. Cleaning of the pump is impeded by these dead spots.

Finally, the prior art discloses piston pumps used for conveying and dosing viscous fluids. Such piston pumps have at least one inlet valve and at least one outlet valve, said valves being lifting valves. Each of said valves is coupled to a control and drive means. This control and drive means is necessary for producing the high closing forces which are srong enough to displace the fluids, which may be highly viscous in some cases, from the valve area and for locally cutting, if necessary, solid components of the substance to be conveyed. The lifting valves can be controlled mechanically or magnetically.

A piston pump of the prior art is known from the handbook "Dosieren", publisher Gerhard Vetter, Vulkan-Verlag Essen, 1994, page 132. This piston pump includes a working space at the top end of which an inlet valve and an outlet valve are arranged on opposite sides. The inlet valve is, at its closed position, held by a seat on which said inlet valve abuts with the valve surface facing away from the working space. For the purpose of opening, the inlet valve is moved from this closed position in the direction of the working space.

It is true that this structural design of the inlet valve has the advantage that, due to the internal pressure effective in the working space when the fluid is being expelled, the valve is pressed against the seat whereby the working space is reliably sealed, but the known piston pump must have a valve space for the inlet valve in which said inlet valve can be moved from its closed position to its open position without colliding with the piston, which, when the inlet valve is being opened, is normally located in the area of its upper dead centre on the same level as the valves.

The known piston pump also includes a valve space for the outlet valve in which said outlet valve, when closed, is accommodated such that a frusto-conical valve member of said outlet valve does not collide with the piston. The valve spaces of the inlet and outlet valves prevent an almost complete evacuation of the space enclosed by the piston, the valves and the cylinder, since a residual volume of the substance to be conveyed will remain in the valve spaces even if the piston abuts, when located at its upper centre, on a cover which is arranged on the front end face of the working space and which covers the cylinder, since the piston can only sweep over the working chamber but not over the valve spaces.

Especially in the case of piston pumps used in the field of the food-processing industry, it is necessary that the whole volume of the substance to be conveyed which has been drawn into the working space is discharged when the piston carries out its stroke. Dead spots are undesirable because they make cleaning of the piston pump more difficult. It should be possible to carry out such cleaning without disassembling the piston pump. In addition, it must be guaranteed that, especially in the case of perishable foodstuff, the substance to be conveyed does not collect in the piston pump, where it may perhaps perish, for a long time. In addition, the substance of an earlier charge contained in the dead space mixes with that of a later charge, when the two charges are conveyed in succession without any intermediate cleaning step. This mixing prevents a really smooth change from one charge to the next; the mixture consisting of the first and second charge and fed by the substance of the first charge contained in the dead spot must be rejected.

SUMMARY OF THE INVENTION

The present invention is based on the technical problem of providing a piston pump which is easy to clean and which includes the smallest possible number of dead spots.

According to a first teaching of the present invention, this problem is solved with the aid of a piston pump by means of the feature that, when closed, the inlet valve is located nearer to the working space than when it is open.

On the basis of the structural design of the inlet valve according to the present invention, it is possible to arrange said inlet valve in such a way that it will delimit the working space directly at its closed position. Since the inlet valve is moved away from the working space for the purpose of opening, it is not necessary to provide a valve space in which the inlet valve can move unhindered even if the piston is located in the area of its upper dead centre. On the basis of the structural design according to the present invention, the inlet opening is, in the open condition of the inlet valve, not partially blocked by distal parts of the valve, i.e. the valve rod connected to the control and drive means of the respective valve. A cleansing fluid flowing in can therefore flow into the working space unhindered. The piston pump, especially the working space and the valve surface facing the working space, can be cleaned more easily in this way. A further essential advantage is that the inlet valve is moved away from the working space for the purpose of opening so that also the substance to be conveyed can flow unhindered into said working space.

The present invention additionally suggests a piston pump comprising at least one working space which is surrounded by a cylinder and which is adapted to be varied by a piston arranged in said cylinder, and at least one inlet valve and at least one outlet valve. The valves are implemented as lifting valves and adapted to be controlled and driven by a control and drive means. In order to provide a piston pump which is easier to clean and which includes the smallest possible number of dead spots, the present invention suggests according to a second teaching that the valve surface facing the working space should merge without any steps with the inner surface of said working space at the closed position of the valves. In this embodiment according to the present invention, the inner walls of the working space are absolutely flat when the valves are closed. Hence, the space enclosed by the piston, by the valves and by the cylinder does not have any steps. This embodiment permits easy cleaning of the piston pump because there are no dead spots where the substance to be removed by rinsing can collect. In the embodiment according to the second teaching of the present invention, it is not necessary that an outwardly opening inlet valve is provided, but smooth inner surfaces of the working space in the closed condition of the valve can also be achieved by an inlet valve opening towards the working space in the manner known.

In the following, preferred further developments of the first and second teaching will be described.

In order to discharge the highest possible amount of the total volume of the substance to be conveyed, which is contained in the working space, with one stroke from said working space, the valves are preferably arranged on the front end face of the working space. On the basis of this structural design, the piston, when located at its upper dead centre, can almost touch the boundary surface delimiting the working space at the front end face thereof. In this preferred embodiment, it is also possible to provide an inwardly opening inlet valve, since, when the filling phase starts, the piston moves downwards and opens simultaneously a space into which the inlet valve to be opened can be moved.

In accordance with a further preferred embodiment of the present invention, the piston surface is convex and the working space is closed by a concave cupola at the front end face thereof, part of the inner surface of said cupola being formed by the valves. By means of the convex structural design of the piston surface in combination with a complementary concave structural design of the end face of the working space, the highest possible degree of discharge of the substance to be conveyed is improved still further. In addition, the curvature of the piston surface can be adapted to the curvature of the concave cupola closing the working space in such a way that, when the working space is reduced in size by the piston, the substance located in the area of the inlet valve will first be pushed towards the outlet valve, whereupon the residual substance remaining in the area of the outlet valve will be conveyed out of the working space almost completely. By means of the curved structural design of the cupola on the one hand and of the piston surface on the other, a rinsing effect is produced. A directional flow of the residual volume of the substance to be conveyed is achieved in the direction of the outlet valve so that the working space can be emptied almost completely in a simple manner. According to a further preferred embodiment of the piston pump according to the present invention, the valve surface of the inlet valve and/or of the outlet valve facing away from working space is convex. When the inlet or outlet valve is drawn back to its open position, which is located farther away from the working space than the closed position, the substance located in the inlet channel and outlet channel, respectively, will be displaced in a simple manner by the convex valve surface facing away from the working space. This has the effect that the substance located behind the respective valve is added to the flow of substance flowing into the working space.

When an inlet channel and an outlet channel are additionally provided, which each have a concave recess for receiving therein the respective valve at its open position, the dead spot remaining between the valve surface facing away from the working space and the wall of the inlet or outlet channels will be minimized. A piston pump is obtained whose inlet and outlet channels are as easy to clean as the working space. Since dead spots, in which the substance can collect, are reduced to a minimum, a change from one charge to the next can be carried out without any substantial mixing of the two charges being caused. On the basis of the structural design according to the present invention, almost the whole volume of the substance contained in the piston pump is located in the flow of substance and is conveyed by the operation of the piston pump. The smallest possible dead space is obtained when the recess and the valve surface facing away from the working space have identical curvatures.

In accordance with a further preferred embodiment of the piston pump according to the present invention, the valve surface facing away from the working space is curved more strongly than the concave recesses of the inlet and outlet channels. These different curvatures result in the formation of a wedge-shaped slot between the valve and the respective wall of the inlet or outlet channel, said slot opening towards the respective inlet or outlet channel. By means of this wedge-shaped slot, the substance located behind the valve is forced out of the concave recess of the respective inlet or outlet channel in a predetermined direction when the valve in question moves to its open position.

In accordance with a further preferred embodiment, the inlet and outlet channels merge without any steps with the valve surface facing the working space at the open position of the valve or of each valve. This has the effect that, at the open position of the respective valve, an inlet channel and an outlet channel, respectively, is created which has flat walls and which does not have any projections to which the substance to be conveyed could adhere.

According to a further preferred embodiment of the piston pump according to the present invention, the circumferential surfaces of the inlet and outlet valves are guided at least partially on a wall of the inlet and outlet channel, respectively. When the respective valve moves from its open position to its closed position, or in the opposite direction, part of the circumferential surface of the valve in question will slide along a wall of the inlet or outlet channel and entrain the substance located in the area of said wall. This will prevent the substance to be conveyed from adhering to the wall of the inlet or outlet channel and from being left behind.

According to the present invention, it is additionally suggested that the valves should be guided in a guide means whose respective opening towards the inlet and outlet channels is provided with a first lip seal. This lip seal prevents the substance to be conveyed from penetrating into the guide means. The substance adhering to the respective valve rod is scraped off by the lip seal, when the valves are being drawn back into the guide means, and remains in the inlet or outlet channel. An effect of the same type can be achieved on the side of the piston, when said piston has a lip seal at the piston edge delimiting the working space. Since the respective lip seals are arranged directly at the opening towards the inlet or outlet channel on the one hand and directly at the piston edge delimiting the working space on the other, there will be no gaps where the substance to be conveyed can collect.

In accordance with a further embodiment, the piston pump according to the present invention can, in addition, comprise a rinsing space surrounding part of each valve and formed between the first and the second lip seal. In this rinsing space the valve rods can be acted upon by a cleansing and/or disinfecting fluid when the piston pump according to the present invention is in operation so as prevent the reciprocating valves from introducing contaminants and germs into the substance to be conveyed. By means of the second lip seal, the rinsing space is sealed from the distal end of the valve rod, which cooperates with the control and drive means.

Finally, in a further preferred embodiment of the present invention, the inlet valve or each inlet valve can be secured in position, when closed, by a blocking device. This blocking device has the effect that the closing forces corresponding to the pressure acting on the outlet valve need not be counteracted by the control and drive means for the inlet valve when the substance is expelled from the working space. Especially, locking means and snap-in means can be implemented as a blocking device. These means can be controlled and driven by a separate control and drive means. It is, however, also imaginable that the blocking device is coupled mechanically to the control and drive means for the respective inlet valve. If the inlet valve is driven and controlled by a crankshaft driving the piston, the blocking device can also be coupled mechanically to the crankshaft. By means of this structural design, the movements of the valves and of the blocking device can be snychronized in a simple manner.

The control and drive means for the lifting valves can be formed by a controlled hydraulic cylinder. In this case, a hydraulic cylinder is implemented as control and drive means for each valve, the hydraulic cylinders being adapted to be controlled independently of one another. Alternatively, the valves can be controlled mechanically. In this case, each valve can be controlled via a separate motor co-operating with the valve e.g. via a cam arranged on the shaft of the motor. A coordinated movement of the piston and of the inlet or outlet valves associated with said piston can be effected in a simple manner by coupling the valves mechanically to the crankshaft driving the piston. This is preferably achieved by means of cam mechanisms which can be connected to the crankshaft via additional levers.

DESCRIPTION OF THE DRAWINGS

In the following, the present invention will be explained in detail on the basis of preferred embodiments making reference to the drawings, in which.

DETAILED DESCRIPTION OF PREFERRED EMBODIMENTS

Figure 1:
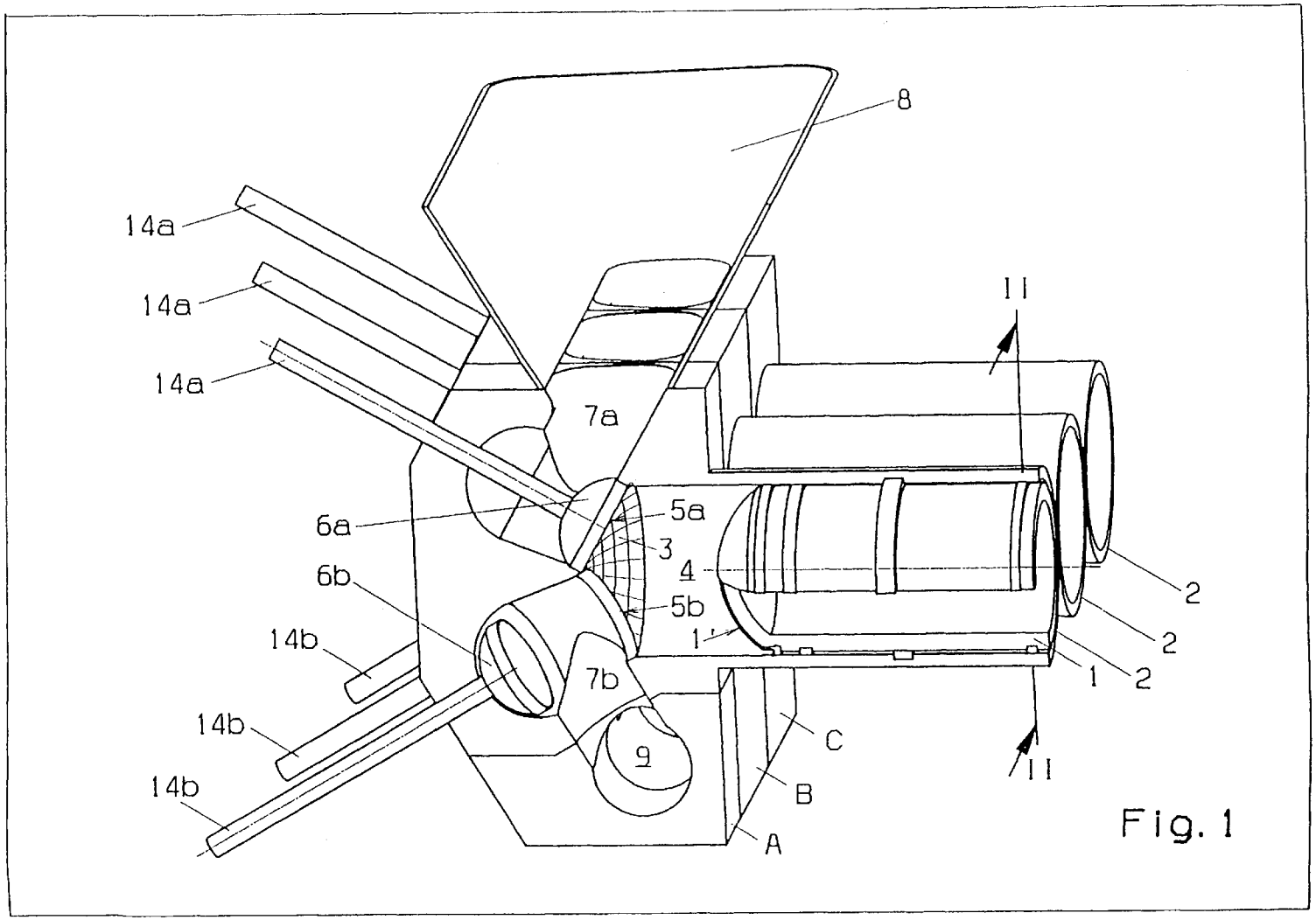
FIG. 1 shows a perspective representation, part of it cut away, of part of a conveyor means including an embodiment of the piston pump according to the present invention.

FIG. 1 shows part of a conveyor means for sausage meat, which comprises the essential components of an embodiment of the piston pump according to the present invention. The piston pump comprises three pistons 1, each of said pistons being accommodated in a cylinder 2. The front end face of each cylinder is closed by a concave cupola 3. The respective cupola 3 and the cylinder 2 associated therewith define a working space 4 whose volume changes due to the movement of the piston 1 in the cylinder 2. The cupola 3 is provided with an inlet opening 5*a* which is closed by an inlet valve 6*a* in the representation according to FIG. 1. The cupola 3 is additionally provided with an outlet opening 5*b* which can be closed by an outlet valve 6*b*. The outlet valve 6*b* is shown at its open position.

When the inlet valves 6*a* are open, the working spaces 4 associated with the respective pistons 1 communicate via an inlet channel 7*a* with a hopper 8 used for receiving therein the substance to be conveyed. At the open position of the outlet valve 6*b* shown in the figure, each working space 4 communicates with an outlet channel 7*b*. Each outlet channel 7*b* communicating with a working space 4 ends in a collecting channel 9 which has an opening, not shown, and through which the food substance conveyed and dosed by the piston pump is discharged for further transport to a processing machine, e.g. a sausage dosing machine.

In the piston pump shown in FIG. 1, the flow channels for the substance to be conveyed are essentially formed in three identical blockshaped components A–C in order to reduce the production costs, said blockshaped components A–C being connected to the respective cylinders 2 and used for guiding the valves 6*a*, 6*b* therein.

Figure 2:
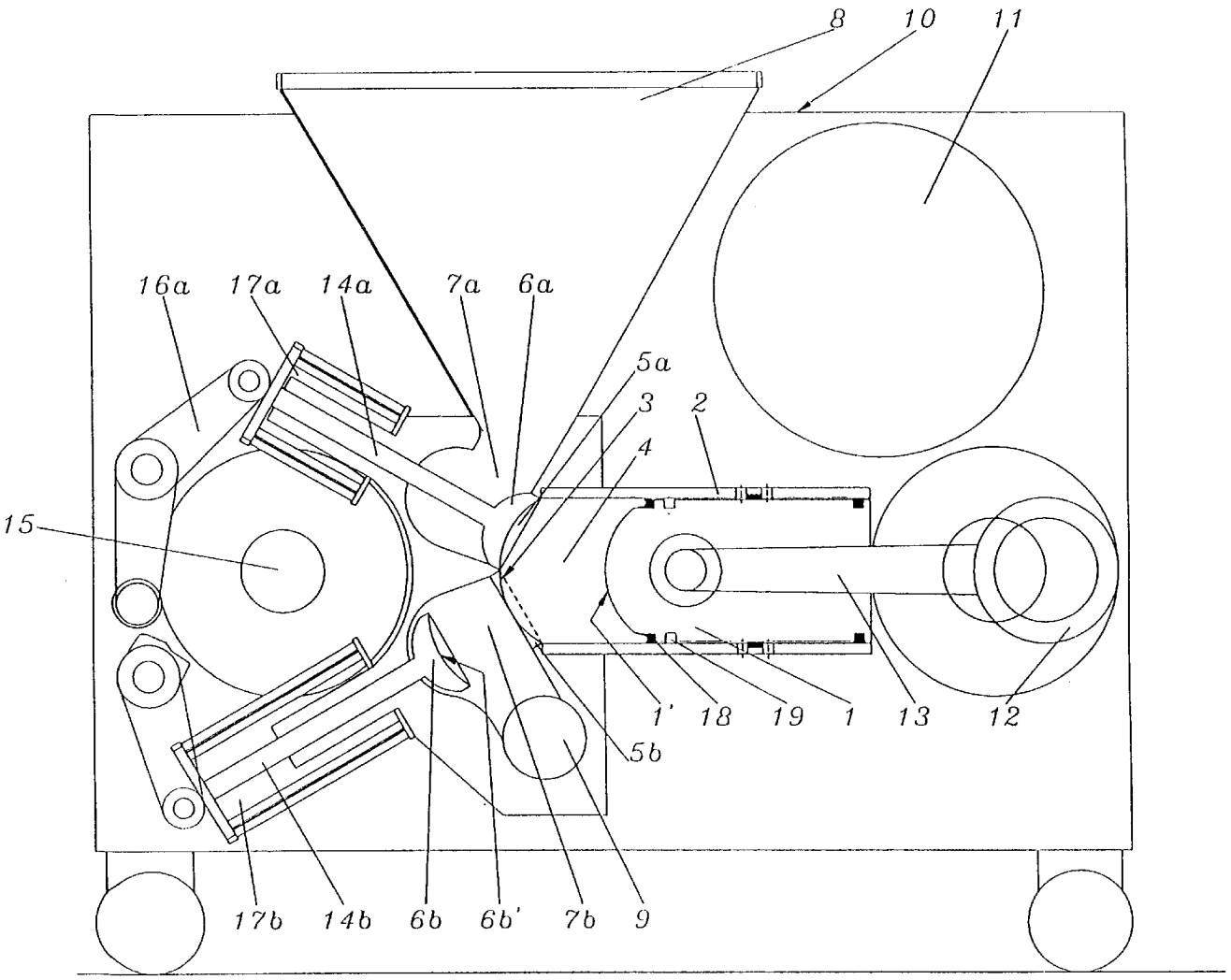
FIG. 2 shows a longitudinal section through a conveyor means for foodstuff along line II—II of the representation in FIG. 1, which includes an embodiment of the piston pump according to the present invention.

Details of the conveyor means shown in FIG. 1 can be seen in the representation according to FIG. 2, which shows a longitudinal section through the conveyor means along the line II—II according to the representation of FIG. 1. The conveyor means is surrounded by a housing 10, part of the hopper 8 projecting beyond the upper surface of said housing. The piston pump as well as a schematically shown motor 11 are accommodated in said housing 10.

Each piston 1 is connected to the motor 11 via a connecting rod 13 which is connected to a crankshaft 12. The two additional connecting rods, which are associated with the two other pistons 1 and which are not shown, are also connected to the crankshaft 12. The eccentrics connected to the connecting rods are distributed over the circumference of the crankshaft 12 for the purpose of balancing the rotating masses.

The valves 6*a*, 6*b* shown are lifting valves and include each a valve rod 14*a*, 14*b*. The distal end of the respective valve rod 14*a*, 14*b* is connected to a control and drive means, which, in the embodiment shown, is defined by a schematically shown camshaft 15, said camshaft 15 being connected to the respective valve 6*a*, 6*b* via rockers; in the figure, only the rocker 16*a* for the inlet valve 6*a* is shown. The overhead camshaft 15 is, in turn, coupled to the crankshaft 12 via a belt, not shown, and is driven by the motor 11 via said crankshaft 12.

Each of the valves 6*a*, 6*b* is spring-loaded by respective schematically indicated springs 17*a*, 17*b* in such a way that it is held at its open position without the influence of the camshaft 15.

In the embodiment shown in FIG. 2, the valves 6*a*, 6*b* have valve surfaces 6*a*', 6*b*' which have a concave curvature and which face the working space. The concave curvature of the respective valve surface 6*a*', 6*b*' corresponds to the curvature of the concave cupola 3 closing the front end face of the working space 4. It follows that, at the closed position of the valves 6, the valve surfaces 6*a*', 6*b*' facing the working space define together with the cupola 3 a surface without any steps, said surface closing the front end face of the working space 4 smoothly.

In the piston pump shown in FIG. 2, the piston has a convex piston surface 1' whose curvature substantially corresponds to the curvature of the cupola 3. In addition, the piston edge closing the working space 4 is provided with a lip seal 18. In addition, a piston ring 19 is provided on the piston 1, said piston ring 19 being in frictional contact with the circumferential surface of the cylinder 2. By selecting respective materials for said piston ring 19, the frictional contact between the piston 1 and the cylinder 2 can be adjusted.

Figure 3:
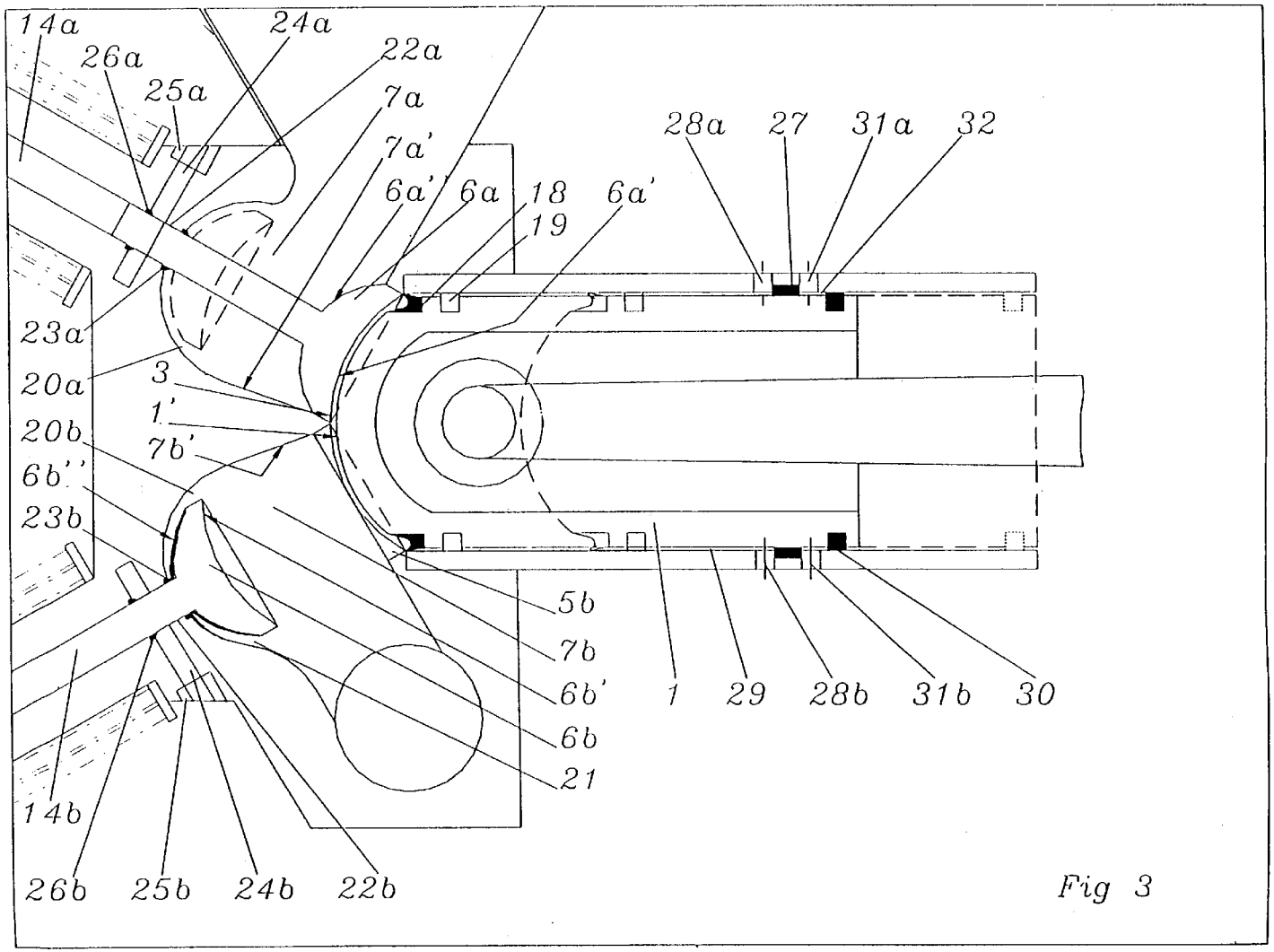
FIG. 3 shows a view of a detail of the piston pump shown in FIG. 2.

Details of the geometrical design of the embodiment shown in FIG. 2 can be seen more precisely in FIG. 3, which shows a detail drawing of the representation in FIG. 2. In comparison with the representation in FIG. 2, the piston 1 is, however, shown at a position where it is located at the upper dead centre, whereas the position of said piston 1 in the area of the bottom dead centre according to FIG. 2 is shown by broken lines in FIG. 3.

The position of the valves 6 in the representation according to FIG. 3 corresponds to the position of said valves 6 shown in FIG. 2. In addition, the open position of the inlet valve 6*a* is shown in FIG. 3 by broken lines.

Each valve 6*a*, 6*b* has a valve surface 6*a*", 6*b*" which faces away from the working space 4 and which has a convex curvature. The inlet and the outlet channels 7*a*, 7*b* each have a concave recess 20*a*, 20*b*, which, in the embodiment shown, is formed symmetrically with regard to the axis of the respective valve rod 14*a*, 14*b*. The curvature of the valve surfaces 6*a*", 6*b*" facing away from the working chamber is somewhat stronger than the curvature of the concave recesses 20*a*, 20*b*. Although this is only outlined for the outlet valve 6*b* in FIG. 3, it also applies to the outlet valve 6*a*. As can be seen from this representation of the outlet valve 6*b*, these different curvatures result in the formation of a wedge-shaped gap 21 between the wall of the recess 20*b* and the valve surface 6*b*", the wide end of said gap 21 opening towards the effective outlet channel. In addition, it can be seen that, at the open position of the outlet valve 6*b*, the outlet channel 7*b* merges without any steps with the valve surface 6*b*' facing the working space 4.

The valve rods 14*a*, 14*b* of the valves 6*a*, 6*b* are guided in a guide means 22*a*, 22*b*, the opening of said guide means 22*a*, 22*b* towards the inlet channel 7*a* and towards the outlet channel 7*b* being provided with a first lip seal 23*a*, 23*b*. The guide means 22*a*, 22*b* additionally comprises a rinsing space 24*a*, 24*b* surrounding part of the respective valve rod 14*a*, 14*b*.

At a connection 25*a*, 25*b*, each rinsing space 24*a*, 24*b* is connected via conduits, not shown, to a piston pump so that a cleansing and/or disinfecting fluid can circulate in the respective rinsing space 24*a*, 24*b*. Each rinsing space 24*a*, 24*b* is, in turn, sealed from the distal end of the respective valve 6*a*, 6*b* by a second lip seal 26*a*, 26*b*. In a similar way, a seal 27 is arranged on the cylinder 2, said seal cooperating with the circumferential surface of the piston 1. Between said seal 27 and the lip seal 18, rinsing fluid can be conducted via a connection 28*a*, 28*b* into a rinsing space 29 which is defined between the piston 1 and the cylinder and which has the shape of an annular gap. For achieving a better distribution of the rinsing fluid, the embodiment shown is provided with two connections 28*a*, 28*b* which are distributed over the circumference. This rinsing system prevents an ingress of air in the same manner as the rinsing spaces 24*a*, 24*b*. In addition, the rinsing system serves to clean the annular gap-shaped rinsing space 29 and the lip seal 18 abutting on the cylinder 2. The piston ring 19 has a plurality of through holes, through which fluid can pass in the axial direction, so as to permit the rinsing fluid introduced through the connections 28*a*, 28*b* to be discharged into the working space 4 and so as to guarantee a uniform distribution of said rinsing fluid in the upper section of the cylinder between the piston ring 19 and the lip seal 18.

In addition to the connections 28*a*, 28*b*, connections 31*a*, 31*b* can be provided on the other side of the seal 27, said connections 31*a*, 31*b* being used for rinsing the annular gap which is formed between the piston 1 and the cylinder 2 and which is open towards the crankshaft.

Alternatively to or additionally to the rinsing of the annular gap between the piston and the cylinder by means of a rinsing fluid, it is possible to prevent the ingress of air and dirt by means of a seal 30 provided on the piston at the piston end facing away from the working space 4 so that a second closed rinsing space 32 is defined.

When the piston pump is in operation, the piston 1 is cyclically reciprocated due to the rotation of the crankshaft 12 so that said piston 1 will cyclically enlarge and reduce the size of the working space 4. By means of the camshaft 15, the valves 6*a*, 6*b* are controlled such that the inlet valve 6*a* is open and the outlet valve 6*b* is closed when the piston 1 carries out a movement by means of which the working space 4 is enlarged, whereas the two valves are positioned the other way round in the case of an opposite movement of the piston 1.

When, due to the rotation of the camshaft 15, the inlet valve 6*a* shown at its closed position in FIG. 3 is drawn back to its open position by the force of the spring 17*a*, the substance located in the valve path of the inlet channel 7*a* is pushed away by the inlet valve 6*a*. In view of the convex curvature of the valve surface 6*a*" facing away from the working space 4, the inlet valve 6*a* will force the substance out of the recess 20*a* until it has reached its open position. This discharge of the substance from the recess 20*a* is facilitated by the fact that the valve surface 6*a*" is curved more strongly than the concave recess 20*a*. The substance passes into the flow of substance extending from the hopper 8 through the effective inlet channel to the working space 4 and is drawn into said working space 4. Since the valve surface 6*a*' facing the working space 4 merges without any steps with the inlet channel 7*a* at the open position of the inlet valve 6*a*, a smooth flow of the substance to be conveyed will be obtained in the inlet channel 7*a* when the working space 4 is being filled.

The same effect is produced by the geometrical design of the outlet channel 7*b* and of the outlet valve 6*b* on the outlet side of the piston pump.

Since the piston 1 has a lip seal 18 on the piston edge delimiting the working space 4, the substance to be conveyed is prevented from penetrating into the gap between the piston periphery and the inner surface of the cylinder during the working movement of the piston 1, and since, in addition, the convex curvature of the piston surface 1' corresponds to the concave curvature of the cupola 3 closing the working space 4 and the piston 1 almost touches the cupola 3 at is upper dead centre, only a minimum amount of the substance to be conveyed will remain in said working space 4 at the end of the phase during which the substance is expelled from the working space 4.

In view of the co-ordinated geometrical design of the cupola 3 and of the piston 1 as well as of the valve surfaces 6' facing the working space 4 on the one hand and in view of the geometrical design of the inlet and outlet channels 7*a*, 7*b* and of the valve surfaces 6*a*", 6*b*" facing away from the working space 4 on the other, the embodiment of the piston pump according to the present invention shown in FIGS. 1 to 3 has almost no dead spots at which the substance to be conveyed can collect. On the contrary, by means of this geometrical design the substance to be conveyed can constantly be kept within the effective flow cross-section by maintaining a flow movement of the substance to be conveyed when the piston pump is in operation. It follows that, when the piston pump is cleaned after dosage of the substance, it will only be a small residual amount of substance that has to be removed from the piston pump by rinsing. Since there are no dead spots at which larger amounts of the substance to be conveyed could collect, cleaning can be carried out without disassembling the piston pump. In addition, it is advantageous that, due to the small residual amount remaining in the piston pump, a change of charges can be carried out without any intermediate cleaning step being required and without any substantial mixing of the old and of the new charge being caused.

The piston pump shown in FIGS. 1 to 3 can be operated at a speed of 30 to 120 revolutions per minute. Each of the three pistons 1 and each of the associated cylinders 2 as well as the stroke are dimensioned such that a cubic capacity of approx. 1.5 liters is obtained. The piston pump shown in the embodiment has therefore a pumping capacity of from 135 to 450 liters per minute. If the substance to be conveyed is sausage meat, a maximum output of approx. 27 tons per hour can be achieved.

Figure 4:
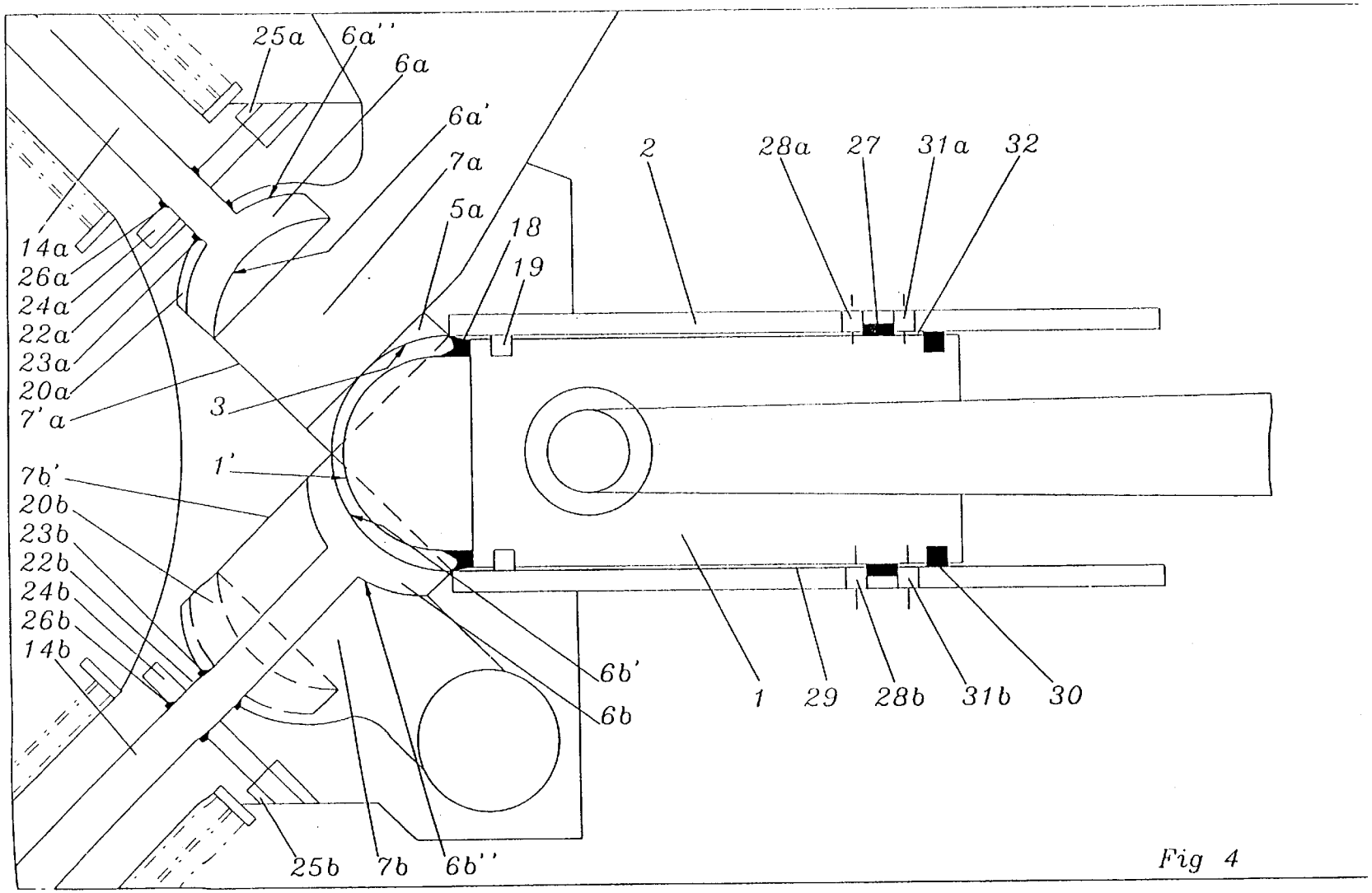
FIG. 4 shows a longitudinal section through the essential parts of a piston pump according to a second embodiment of a piston pump according to the present invention.

FIG. 4 shows a further embodiment of the essential components of the piston pump according to the present invention. In comparison with FIGS. 1 and 3, like reference numerals have been used to designate identical structural components.

The embodiment shown in FIG. 4 is provided with a piston surface 1' which is convex and which has the shape of a hemisphere. Accordingly, also the cupola 3 has a hemispherical shape to the curvature of which also the valve surfaces 6*a*', 6*b*' facing the working space 4 are adapted. By means of the curvature of the piston surface 1' on the one hand and that of the cupola 3 on the other, the pumping behaviour of the piston pump is influenced. With the aid of an appropriate adaptation of the respective geometry, a directional flow towards the outlet opening 5*b* can be achieved, especially in the last section of the piston stroke, whereby the discharge of the substance from the working space 4 will be improved.

In the valves 6*a*, 6*b* shown in FIG. 4, a circumferential surface 6*a*" of the inlet valve 6*a* and a circumferential surface 6*b*" of the outlet valve 6*b* abut on a wall 7*a*' and 7*b*' of the inlet channel 7*a* and of the outlet channel 7*b*, respectively. This has the effect that, when the valves 6*a*, 6*b* move, the substance adhering to the walls 7*a*', 7*b*' will be scraped off. The most complete possible movement of the substance located in the inlet channel and in the outlet channel is thus improved when the piston pump is in operation. This effect is increased in proportion to the percentage of circumferential surface abutting on the walls 7*a*', 7*b*' of the inlet channel 7*a* and of the outlet channel 7*b*, respectively. Good results can be achieved when the inlet and outlet channels 7*a*, 7*b* merge via a cylindrical portion having a round cross-sectional area with the inlet opening 5*a* and the outlet opening 5*b*, respectively, and when the circumferential surfaces 6*a*", 6*b*" of the valves 6*a*, 6*b* are the circumferential surface of a circle.

For production reasons, the inlet channel 7*a* and the outlet channel 7*b* of the embodiment shown in FIG. 4 are not provided with spherically curved reception means for the valves 6*a*, 6*b*. Instead of such spherically curved reception means, the walls of the reception means are formed concavely by oblique walls. This embodiment is less difficult to manufacture and it produces an effect which is almost as good as that produced by the spherically curved recesses 20*a*, 20*b* according to the embodiment shown in FIGS. 1 to 3.

Since the embodiments of the piston pump according to the present invention shown in FIGS. 1 to 4 have an outwardly opening inlet valve 6*a*, i.e. an inlet valve which, when closed, is located nearer to the working space than when it is open, the substance can flow in without being impeded by parts of said inlet valve 6*a* in the area of the inlet opening 5*a*. Due to the position of the lip seal 18 of the piston 1 and the position which the lip seals 23*a*, 23*b* occupy relative to the respective valves 6*a*, 6*b*, gaps in which the substance to be conveyed can collect are avoided at these locations.

Since the cupola 3 closing the working space 4 defines together with the valve surfaces 6*a*', 6*b*' facing the working space 4 a smooth surface when the valves are closed, the working space can be cleaned easily. The valve spaces known from the prior art, which form steps and in which the substance to be conveyed can collect, do not exist. Since, in addition, almost the entire volume enclosed by the piston 1 and the cupola 3 in the closed condition of the valves 6*a*, 6*b* is part of the working space 4 and is swept over by the reciprocating piston 1, almost the whole substance to be conveyed will have been discharged from the working space 4 at the end of the expelling phase. If the piston surface 1' touches the cupola 3 at the upper dead centre of the piston 1, the residual amount remaining in the working space 4 is negligible.

By means of the cleansing and/or disinfecting fluid circulating in the rinsing space 24*a*, 24*b*, germs on the respective valve rod 14*a*, 14*b* are killed and contaminants are set free by rinsing. Since the valve rods 14*a*, 14*b* are drawn almost completely through the rinsing space 24*a*, 24*b* in question due to the movement of the respective valves 6*a*, 6*b*, the cleaning and/or disinfecting effect is achieved along a great length of the valve rod 14*a*, 14*b*.

In addition, an excess pressure can be produced in the rinsing space in a separate cleaning step carried out for cleaning the lip seals; by means of said excess pressure, the cleansing and/or disinfecting fluid flows past the lip seals and into the inlet and outlet channels.

What is claimed is:

1. A piston pump comprising in combination at least one working space (4) which is surrounded by a cylinder (2) and which is adapted to be varied by a piston (1) arranged in said cylinder (2), at least one inlet valve (6*a*) and at least one outlet valve (6*b*), said valves (6*a*, 6*b*) being lifting valves and being adapted to be controlled and driven by a control and drive means (15, 16*a*, 17*a*, 17*b*), wherein when closed, said inlet valve (6*a*) is located nearer to said working space (4) than when it is open, wherein said valves (6) are arranged on a front end face of said working space (4), wherein a piston surface (1') is convex and said working space (4) is closed by a concave cupola (3) at a front end face of the working space, and wherein part of an inner surface of said cupola (3) is formed by said valves (6*a*, 6*b*).

2. A piston pump according to claim 1, wherein a valve surface (6*a*", 6*b*") of at least one of said inlet or outlet valves (6*a*, 6*b*) facing away from said working space (4) is convex.

3. A piston pump according to claim 2, wherein an inlet channel (7*a*) and an outlet channel (7*b*) are provided, each of said channels having a concave recess (20*a*, 20*b*) for receiving therein the respective said valve (6*a*, 6*b*) at its open position.

4. A piston pump according to claim 3 wherein said valve surface facing away from said working space (4) has a smaller radius of curvature than said concave recesses (20*a*, 20*b*) of said inlet and outlet channels (7*a*, 7*b*).

5. A piston pump according to claim 3 wherein said inlet and outlet channels (7*a*, 7*b*) merge without any steps with said valve surface (6*a*', 6*b*') of at least one of said inlet or outlet valves (6*a*, 6*b*) facing said working space (4) at the open position of said valve (6*a*, 6*b*).

6. A piston pump according to claim 3, wherein the circumferential surfaces of said inlet and outlet valves (6*a*, 6*b*) extend between the valve surface (6*a*", 6*b*") facing away from the working space (4) and the valve surface (6*a*', 6*b*') facing the working space (4) and abut at least partially on a wall (7*a*', 7*b*') of said inlet and outlet channel (7*a*, 7*b*), respectively.

7. A piston pump according to claim 3, wherein said valves (6*a*, 6*b*) are guided in a guide means (22*a*, 22*b*) having an opening towards said inlet and outlet channels (7*a*, 7*b*) that is provided with a first lip seal (23*a*, 23*b*).

8. A piston pump according to claim 7, wherein said guide means (22*a*, 22*b*) comprises a rinsing space (24*a*, 24*b*) surrounding part of each of said valves (6*a*, 6*b*) and formed between said first and a second lip seal (26*a*, 26*b*).

9. A piston pump comprising in combination at least working space (4) which is surrounded by a cylinder (2) and which is adapted to be varied by a piston (1) arranged in said cylinder (2), at least one inlet valve (6*a*) and at least one outlet valve (6*b*), said valves (6*a*, 6*b*) being lifting valves and being adapted to be controlled and driven by a control and drive means (15, 16*a*, 17*a*, 17*b*), wherein when closed, said inlet valve (6*a*) is located nearer to said working space (4) than when it is open and wherein a valve surface (6*a*', 6*b*') of at least one of said inlet or outlet valves (6*a*, 6*b*) facing said working space (4) merges without any steps with the inner surface of said working space (4) at the closed position of said valve (6*a*, 6*b*).

10. A piston pump according to claim 9, wherein said valves (6) are arranged on a front end face of said working space (4).

11. A piston pump according to claim 10, wherein a piston surface (1') is convex and said working space (4) is closed by a concave cupola (3) at a front end face of the working space, and part of an inner surface of said cupola (3) being formed by said valves (6*a*, 6*b*).

12. A piston pump according to claim 10, wherein a valve surface (6*a*", 6*b*") of at least one of said inlet or outlet valves (6*a*, 6*b*) facing away from said working space (4) is convex.

13. A piston pump according to claim 12, wherein an inlet channel (7*a*) and an outlet channel (7*b*) are provided, each of said channels having a concave recess (20*a*, 20*b*) for receiving therein the respective said valve (6*a*, 6*b*) at its open position.

14. A piston pump according to claim 13, wherein said valve surface facing away from said working space (4) has a smaller radius of curvature than said concave recesses (20*a*, 20*b*) of said inlet and outlet channels (7*a*, 7*b*).

15. A piston pump according to claim 13, wherein said inlet and outlet channels (7*a*, 7*b*) merge without any steps with said valve surface of at least one of said inlet or outlet valves (6*a*, 6*b*) extending between the valve surface (6*a*", 6*b*") facing away from the working space (4) and the valve surface (6*a*', 6*b*') facing the working space (4) at the open position of said valve (6*a*, 6*b*).

16. A piston pump according to claim 13, wherein the circumferential surfaces of said inlet and outlet valves (6*a*, 6*b*) extending between the valve surface (6*a*", 6*b*") facing away from the working space (4) and the valve surface (6*a*', 6*b*') facing the working space (4) abut at least partially on a wall (7*a*', 7*b*') of said inlet and outlet channel (7*a*, 7*b*), respectively.

17. A piston pump according to claim 13, wherein said valves (6*a*, 6*b*) are guided in a guide means (22*a*, 22*b*) having an opening towards said inlet and outlet channels (7*a*, 7*b*) that is provided with a first lip seal (23*a*, 23*b*).

18. A piston pump according to claim 17, wherein said guide means (22*a*, 22*b*) comprises a rinsing space (24*a*, 24*b*) surrounding part of each said valve (6*a*, 6*b*) and formed between said first and a second lip seal (26*a*, 26*b*).

* * * * *